US006418838B1

(12) United States Patent
Bobren et al.

(10) Patent No.: US 6,418,838 B1
(45) Date of Patent: Jul. 16, 2002

(54) STRAPPING MACHINE HAVING AN EASY CLEAR STRAP ACCUMULATOR BOX

(75) Inventors: Allan J. Bobren, Streamwood; Darryl M. Devine, Huntley, both of IL (US)

(73) Assignee: Illinois Tool Works, Glenview, IL (US)

( * ) Notice: Subject to any disclaimer, the term of this patent is extended or adjusted under 35 U.S.C. 154(b) by 95 days.

(21) Appl. No.: 09/599,800

(22) Filed: Jun. 22, 2000

(51) Int. Cl.[7] ..... B65B 13/18; B65B 13/06

(52) U.S. Cl. ..... 100/26; 53/589; 100/8; 226/118.4

(58) Field of Search ..... 100/1, 8, 26, 29, 100/32, 33 PB; 53/589; 226/118.4

(56) References Cited

U.S. PATENT DOCUMENTS

| | | | | | |
|---|---|---|---|---|---|
| 3,447,447 | A | * | 6/1969 | Rutty | 100/26 |
| 3,613,976 | A | * | 10/1971 | Guerrero et al. | 226/118.4 |
| 4,651,944 | A | * | 3/1987 | Bader, Jr. | 226/118.4 |
| 5,112,004 | A | * | 5/1992 | Tipton | 226/118.4 |
| 5,640,899 | A | | 6/1997 | Bell et al. | |
| 5,657,612 | A | | 8/1997 | Renz et al. | |
| 5,718,167 | A | | 2/1998 | Renz et al. | |
| 5,746,882 | A | | 5/1998 | Bell et al. | |
| 5,809,873 | A | * | 9/1998 | Chak et al. | 100/26 |
| 6,039,286 | A | | 3/2000 | Abrams et al. | |

FOREIGN PATENT DOCUMENTS

| | | | | |
|---|---|---|---|---|
| GB | 2203717 A | * | 10/1988 | 100/26 |
| JP | 1-254508 A | * | 10/1989 | 100/26 |

* cited by examiner

*Primary Examiner*—Stephen F. Gerrity
(74) *Attorney, Agent, or Firm*—Welsh & Katz, Ltd.; Mark W. Croll, Esq.; Donald J. Breh, Esq.

(57) ABSTRACT

A strapping machine having a strap accumulator box with an easy access panel is provided. The strapping machine includes a lever that allows for the quick opening of the easy access panel and the quick clearing of the strapping machine of strap debris and jams. The strapping machine of the present invention further includes a lever for quick release of the access panel. The access panel is spring biased in a first closed position and, upon the clearing of strap debris and jams, the access panel is returned to its first closed position.

4 Claims, 3 Drawing Sheets

STRAPPING MACHINE HAVING AN EASY CLEAR STRAP ACCUMULATOR BOX

FIELD OF THE INVENTION

The present invention concerns a novel strapping machine having an easy clear slack box allowing the opening of the outer housing of a strapping machine to remove excess strap and strapping debris.

BACKGROUND OF THE INVENTION

The use of strapping machines causes debris from the strap material to accumulate within the strapping machine. It has been found that, due to the accumulation of debris, the strapping must be stopped often and the machine must be cleared so that it may continue to be operated. The accumulation of strap may cause the machine tojam and/or the various parts that create a path for the strap to be forced out of alignment. Misalignment of the strap path often results in the jamming of the strap machine and may cause damage to strap path elements.

In most strapping machines presently in use, the machine must be disassembled on occasion during use and cleared of strap debris. Such disassembly, clearing and reassembly, while necessary, is time consuming and removes a strapping machine from its strapping tasks.

It would be preferable to have a machine that would allow easy access to the interior of the machine so that it could be cleared of strap debris and jams without having to disassemble the machine and remove it from its strapping tasks for extended periods of time. Further, such a machine, due to the ease of opening the strap accumulator box, would allow for more prophylactic cleaning so that strap jams may mostly be avoided.

SUMMARY OF THE INVENTION

In accordance with the present invention, a strapping machine, having an easy clear strap accumulator box or slack box, comprising, a strapping machine housing and a strap path is provided. The strap accumulator box, defined below the strap path, comprises an area for strap and debris collection, a lower assembly or door, and a door release lever. The lower assembly or door is rotationally attached to the strapping machine housing such that upon the operation of the release lever the lower assembly may be rotated to an open position allowing the accumulator box to be cleared of strap debris.

In the preferred embodiment of the present invention, the lower assembly or door of the accumulator box is spring biased in a first closed position. The assembly release lever may be depressed, by hand or foot, to release the lower assembly door such that it may be rotated away from the accumulator box, allowing strap debris to fall from the strapping machine, and allow for the clearing ofjams from the slack accumulator box and strap path. In the preferred embodiment of the present invention, depression of the release lever causes the accumulator box door to rotate open and release of the lever causes the door to rotate to its default closed position.

It may be seen that the accumulator box door may be maintained in an open position, by for example lever locking means, to allow for a more thorough inspection and cleaning of the strap accumulator area and the strap path. It is to be understood that while the accumulator box door of the present invention is located at the bottom of the strapping machine, the door may be placed at the side of the machine and allow similar access to the accumulator box, for clearing and maintenance, without departing from the novel scope of the present invention.

A more detailed explanation of the invention is provided in the following description and claims and is illustrated in the accompanying drawings.

DETAILED DESCRIPTION OF THE ILLUSTRATIVE EMBODIMENT

Figure 5:
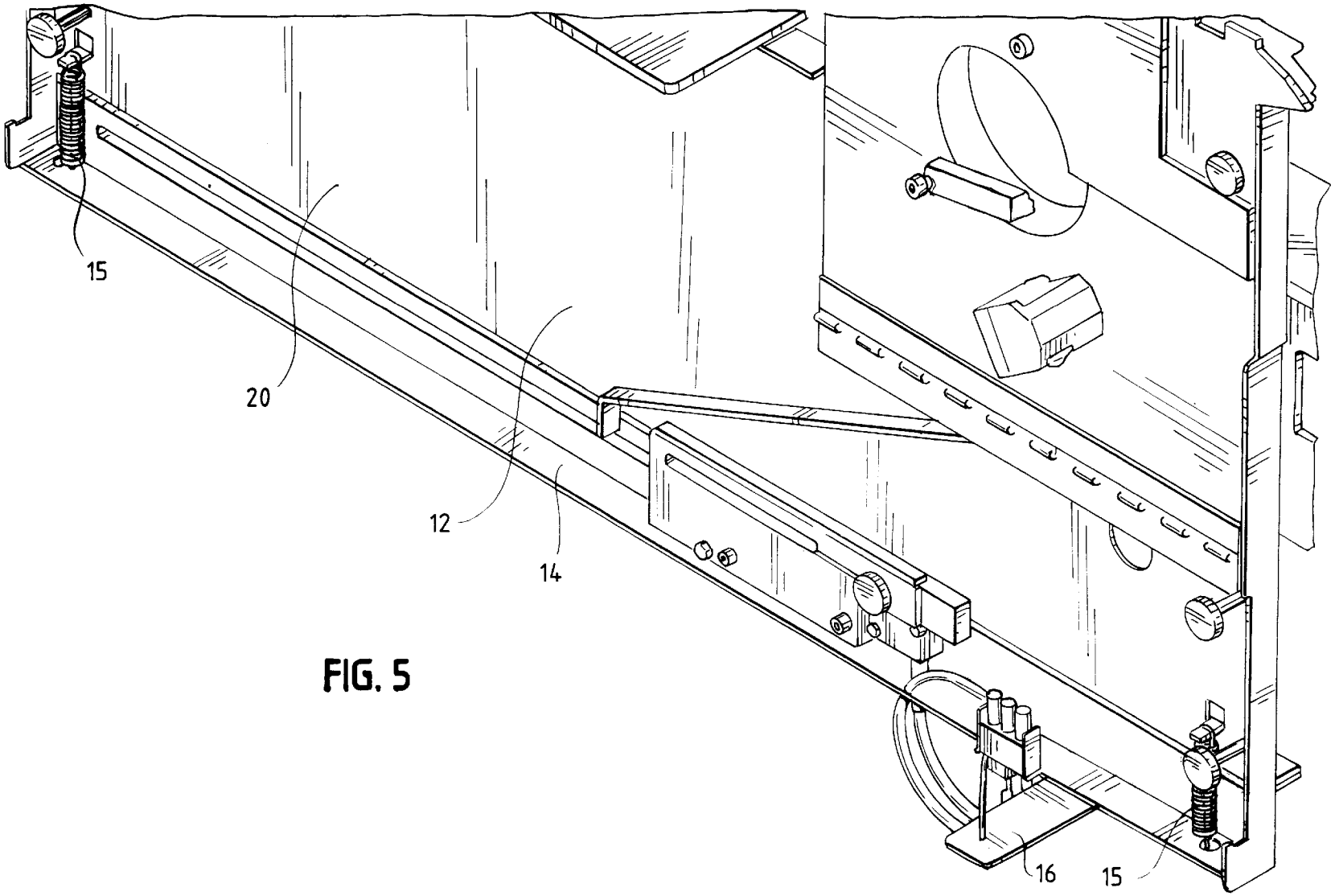
FIG. 5 is a perspective view of the strap accumulator box of FIG. 1, broken away to show the interior of the strap accumulator box.
Figure 6:
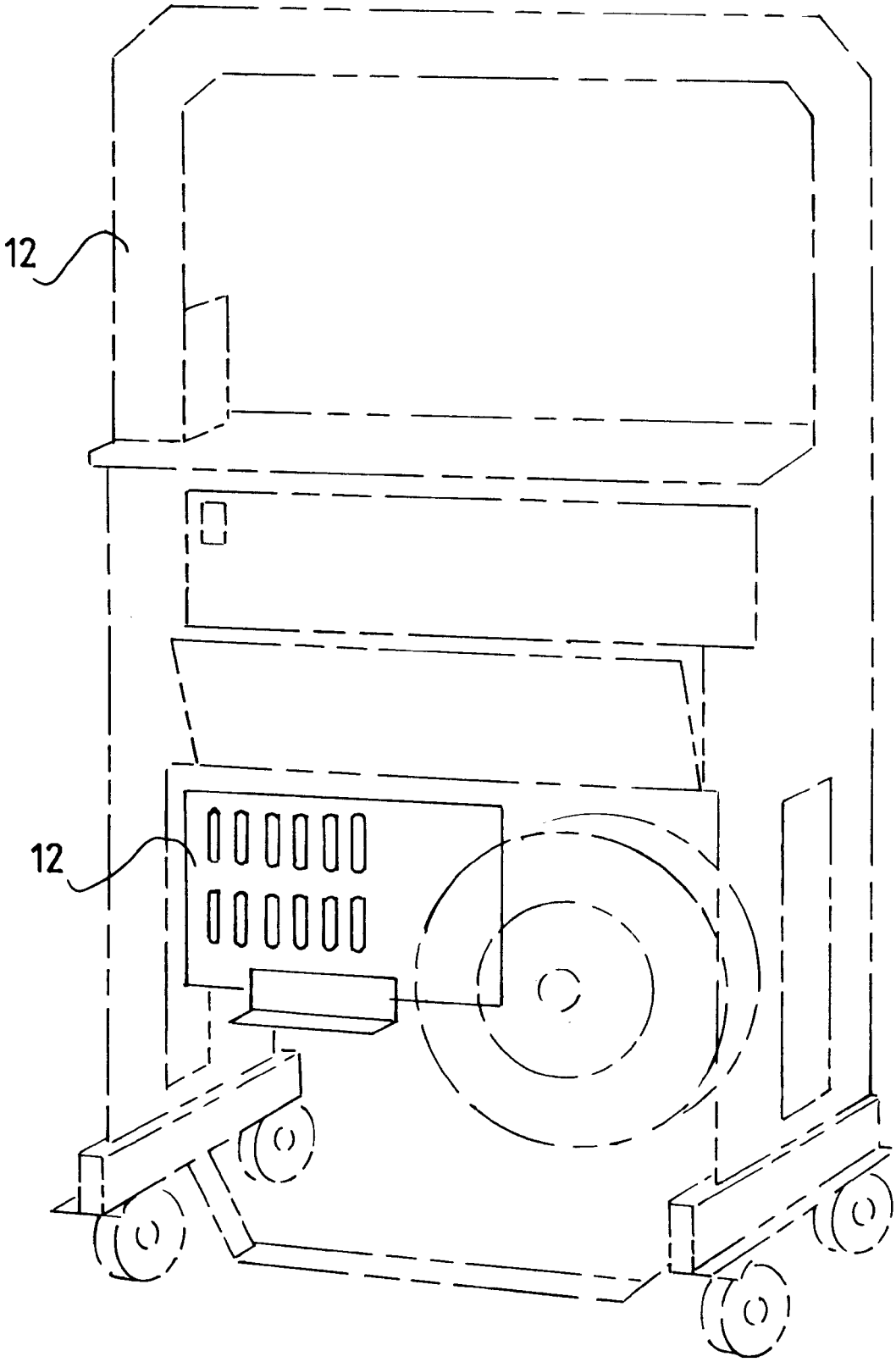
FIG. 6 is a perspective view of the strap accumulator box of FIG. 1, in position on a strapping machine shown in phantom lines.

Referring to the drawings, FIGS. 1, 2, 5 and 6 show a strapping machine 10, of a design well known in the art, having strap accumulator box 12, the strap accumulator box 12 includes an open end 13, and a lower assembly or strap clearing door 14 covering said open end 13. Referring to FIG. 5, strap accumulator box 12 forms an interior space 20 within box 12, which provides space to hold scrap materials prior to the clearing of strap accumulator box 12. A lever 16, attached to said strap accumulator box 12 and a spring 15, biasing said strap clearing door 14 in a first closed position, are shown. It will be understood, by persons having skill in the art, that inherent in the present embodiment of the invention is the use of a coil-type spring 15 to bias strap clearing door 14 in a first closed position.

Figure 1:
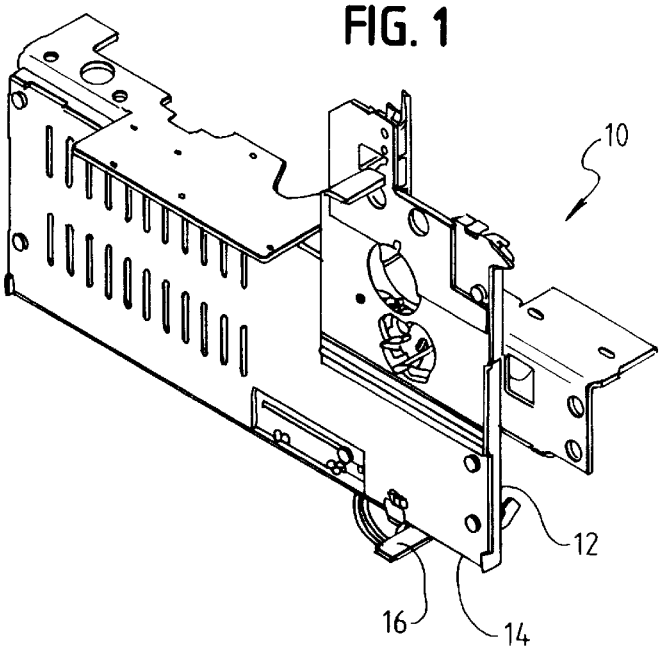
FIG. 1 is a perspective view of a strap accumulator box, having a strap clearing door of the present invention in a first, closed, position.
Figure 2:
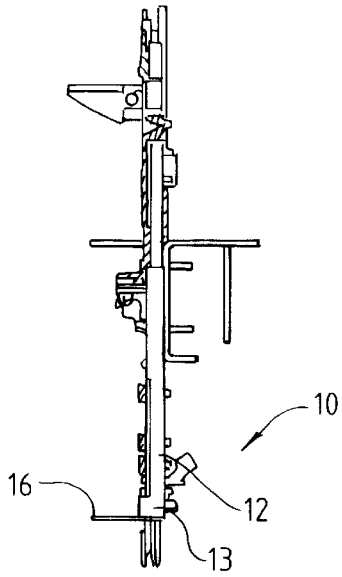
FIG. 2 is a side elevational view of the strap accumulator box of FIG. 1.
Figure 3:
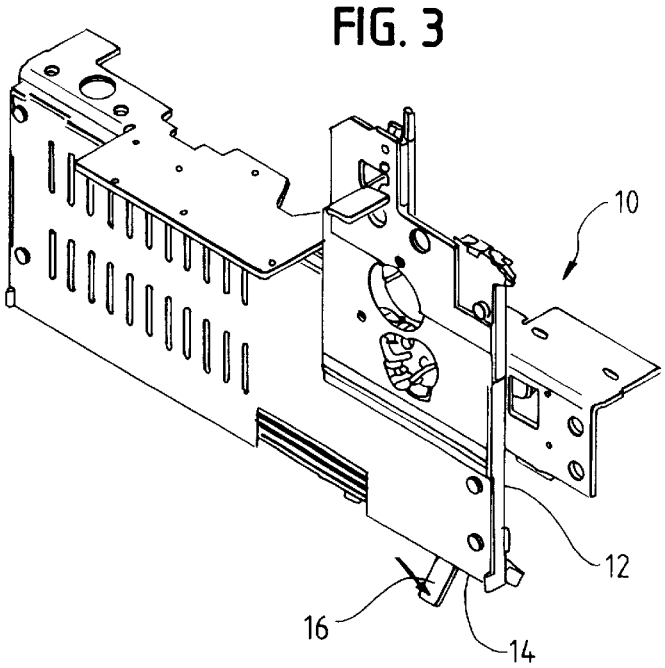
FIG. 3 is a perspective view of a strap accumulator box, having a strap clearing door of the present invention is a second, opened, position.
Figure 4:
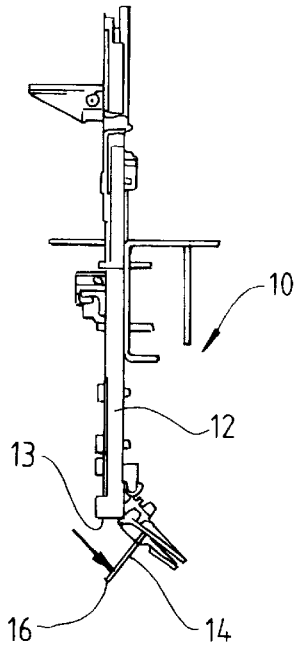
FIG. 4 is a side elevational view of the strap accumulator box of FIG. 3.

FIGS. 3 and 4 show strapping machine 10 with strap clearing door 14 in a second open position. It may be seen, in FIG. 4, that any loose strap material held in accumulator box 12 may freely fall from strapping machine 10 when said strap clearing door 14 is opened. It will be understood, from FIGS. 3 and 4, that clearing door 14 is rotationally attached, in a manner well known in the art, to accumulator box 12.

When clearing of the strap accumulator box 12 is desired, strapping machine 10 is stopped and lever 16 is depressed causing strap-clearing door 14 to pivot down on a hinge until door 14 is open. As door 14 is generally at the bottom of the strapping machine 10, excess debris and strap pieces fall out of interior space 20 of strapping accumulator box 12 through open end 13 by gravity. When door 14 is in an open position, the entire slack box 12 may be cleared of debris and excess strap material. When strap and debris have been cleared from the strap accumulator box 12, door 14 may be returned to its first, closed position, upon the release of lever 16. Spring 15 causes door 14 to return to cover open end 13, upon the release of lever 16.

It may be seen that the operation of the easy clear strap box of the present invention may proceed with minimal interruption in the strapping process.

Although an illustrative embodiment of the invention has been shown and described, it is to be understood that various modifications and substitutions may be made by those skilled in the art without departing from the novel spirit and scope of the invention.

What is claimed is:

1. A strapping machine, having an easy clear strap accumulator box enabling debris removal, said machine, comprising:

a strapping machine housing;

a strap path;

a strap accumulator box, defined below said strap path, said strap accumulator box including, an area for debris collection, a lower assembly located generally at the bottom of said accumulator box to enable debris to fall therefrom, and an assembly release lever;

said lower assembly being rotationally attached to said strap accumulator box such that upon the operation of said release lever, said lower assembly may be rotated to an open position and said accumulator box may be cleared of strap.

2. The strapping machine of claim 1, wherein said lower assembly is held in a first closed position by a biasing element.

3. The strapping machine of claim 2, wherein said biasing element is a spring.

4. A strapping machine, having an easy clear strap accumulator box enabling debris removal, said strapping machine comprising:

a strapping machine housing;

a strap path;

a strap accumulator box, defined below said strap path, said strap accumulator box including, an area for debris collection, a lower assembly located generally at the bottom of said accumulator box to enable debris to fall therefrom, and an assembly release lever;

said lower assembly being rotationally attached to said strap accumulator box and biased by a spring in a first closed position, such that the operation of said release lever, said lower assembly may be rotated to an open position and said accumulator box may be cleared of strap and upon release of said lever, said lower assembly rotates back to its first closed position.

* * * * *